US005147384A

United States Patent [19]

La Rocca

[11] Patent Number: 5,147,384

[45] Date of Patent: Sep. 15, 1992

[54] PACIFIER TETHER FOR USE IN ENHANCING AN INFANT'S DEVELOPMENTAL REFLEXES

[76] Inventor: Mechelle La Rocca, 6109 Preston Creek Dr., Dallas, Tex. 75240

[21] Appl. No.: 718,204

[22] Filed: Jun. 20, 1991

[51] Int. Cl.[5] ..... A61J 17/00

[52] U.S. Cl. ..... 606/234; 606/236; 215/11.1

[58] Field of Search ..... 606/234, 235, 236; 428/139, 131, 137; 2/104; 215/11.1-11.6

[56] References Cited

U.S. PATENT DOCUMENTS

| | | | |
|---|---|---|---|
| 1,029,204 | 6/1912 | Luft | 428/131 |
| 2,811,949 | 11/1957 | Rothbard | 606/236 |
| 2,834,350 | 5/1958 | Beck, Jr. et al. | 606/236 |
| 3,283,758 | 11/1966 | Killebrew | 606/234 |
| 4,697,589 | 10/1987 | King et al. | 606/234 |
| 4,969,894 | 11/1990 | Hempstead-Harris | 606/234 |
| 5,049,127 | 9/1991 | Yen Tseng | 606/236 |

*Primary Examiner*—Stephen C. Pellegrino
*Assistant Examiner*—Glenn K. Dawson
*Attorney, Agent, or Firm*—David H. Judson

[57] ABSTRACT

A pacifier tether for use in conjunction with a pacifier to enhance developmental reflexes in an infant. The tether comprises a generally elongate body. The body comprises an upper fabric layer having a central portion and first and second extensions extending from the central portion, and first and second fabric layers underlying the first and second extensions, respectively, and stitched thereto. A reinforcing disk, preferably formed of several fabric layers, overlies the central portion of the upper fabric layer and is stitched thereto. An aperture is formed in the reinforcing disk and the central portion of the upper fabric layer for receiving the nipple of a pacifier. The reinforcing disk maintains the nipple in an upright midline position and insures that the infant's nose remains spaced from the fabric. The pacifier tether further includes a reinforced pocket underlying the aperture. The pacifier base is retained in the pocket.

8 Claims, 2 Drawing Sheets

PACIFIER TETHER FOR USE IN ENHANCING AN INFANT'S DEVELOPMENTAL REFLEXES

TECHNICAL FIELD

The present invention relates generally to pacifier devices and more particularly to a pacifier tether for enhancing development of certain inborn reflexes of a newborn or young infant.

BACKGROUND OF THE INVENTION

Premature or so-called "preterm" infants often exhibit development problems. It is known in the neonatal care art that such problems can be ameliorated through enhancing nonnutritive sucking (NNS). NNS accelerates the maturation of the sucking reflex and enhances gastrointestinal function. It results in higher transcutaneous arterial oxygen levels during gavage feedings, reduces energy expenditures and decreases restlessness. When NNS is given during gavage feedings, preterm infants gain weight more rapidly and begin bottle feedings sooner. Infants given NNS just before a feeding spend less time in restless states and more time in awake alert states. An infant brought to an alert wakeful state through repeated opportunities for NNS is more responsive and receptive to environmental stimuli.

It is known in the prior art to provide tether devices for retaining a pacifier in or near an infant's mouth. Such devices are shown, for example, in U.S. Pat. Nos. 2,811,949 and 4,697,589. Other pacifier tether devices useful as toys or the like are shown in U.S. Pat. Nos. D225,039, D310,716 and 3,283,758. Tethered teething devices are shown in U.S. Pat. Nos. D288,849, D310,710 and 2,827,055. Such prior art devices, however, are not useful for enhancing NNS and other developmental reflexes in a neonatal environment.

There is therefore a need to provide a pacifier tether that facilitates NNS and other developmental reflexes and that overcomes the problems associated with prior art devices.

BRIEF SUMMARY OF THE INVENTION

It is an object of the present invention to provide a pacifier tether useful in enhancing developmental reflexes including nonnutritive sucking, the grasp reflex and the hand-to-mouth reflex.

It is a further object of the invention to provide a pacifier tether that brings the infant's arms midline when the infant grasps the tether. By bringing the arms midline, total body flexion is encouraged, thus leading to increased muscle tone. Neurobehaviorial organization is also enhanced by bringing the arms midline and by encouraging the grasp and suck reflex through use of the present invention. As such behavior comes into balance, the autonomic system improves.

It is still another object to provide a tether device that promotes tactile and visual stimulation.

It is yet another object to provide a pacifier tether that can be rewashed and reused, and that allows the care provider or parent to easily remove and replace the pacifier.

These and other objects of the invention are provided in a pacifier tether for use in conjunction with a pacifier to enhance developmental reflexes in an infant, the pacifier having a base and a nipple. In the preferred embodiment, the tether comprises a generally elongate body. The body comprises an upper fabric layer having a central portion and first and second extensions extending from the central portion, and first and second fabric layers underlying the first and second extensions, respectively, and stitched thereto. A reinforcing disk, preferably formed of several fabric layers, overlies the central portion of the upper fabric layer and is stitched thereto. An aperture is formed in the reinforcing disk and the central portion of the upper fabric layer for receiving the nipple of a pacifier. The reinforcing disk maintains the nipple in an upright midline position and insures that the infant's nose remains spaced from the fabric. The pacifier tether further includes a reinforced pocket underlying the aperture. The pacifier base is retained in the pocket. With this construction, the pacifier can be readily removed from the tether and the tether washed for reuse.

Preferably, the tether body is formed of soft washable, flame retardant fabric such as flannel or other polyester/cotton or wool/cotton blend. The body includes visual designs or coloration to enhance visual stimulation.

The foregoing has outlined some of the more pertinent objects of the present invention. These objects should be construed to be merely illustrative of some of the more prominent features and applications of the invention. Many other beneficial results can be attained by applying the disclosed invention in a different manner of modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which.

Similar reference characters refer to similar parts throughout the several views of the drawings.

DETAILED DESCRIPTION

The pacifier tether of the present invention will be described below in the context of neonatal care of a preterm infant. It should be appreciated, however, that the teachings of the invention are not so limited as the invention is useful for the care of all newborn infants as well as infants having developmental dysfunction.

Figure 1:
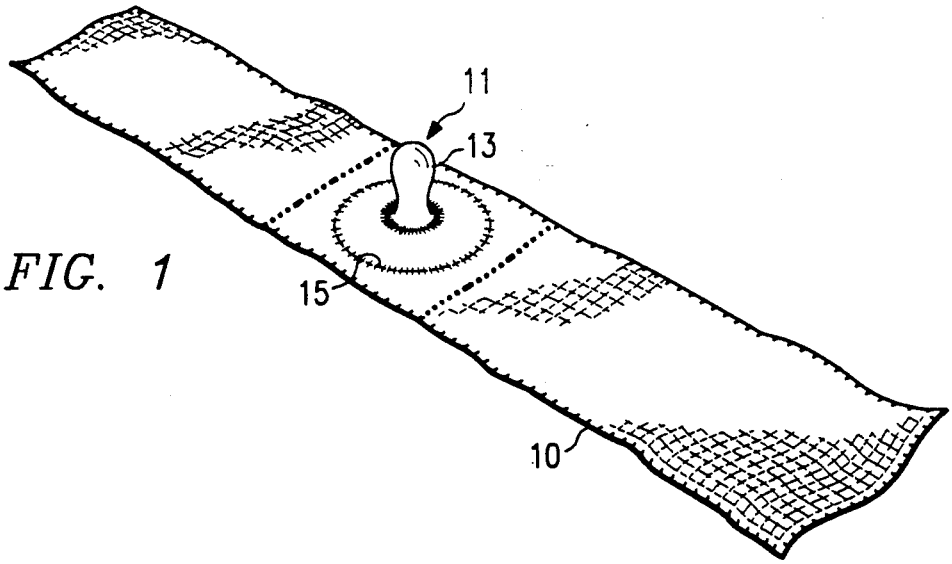
FIG. 1 is a perspective view of the combined pacifier tether and pacifier of the present invention.

FIG. 1 is a perspective view of the pacifier tether 10 with a pacifier 11 supported therein. The pacifier 11 includes a nipple 13 and a pacifier base 15 retained within the tether as will be described below. Any type of pacifier is useful in conjunction with the tether 10. The "standard" and "premie" pacifiers available from Ross Laboratories are preferred. The tether 10 is generally formed of soft washable, flame retardant fabric such as flannel or other polyester/cotton or wool/cotton blend. It includes visual designs or coloration to enhance visual stimulation.

Figure 2:
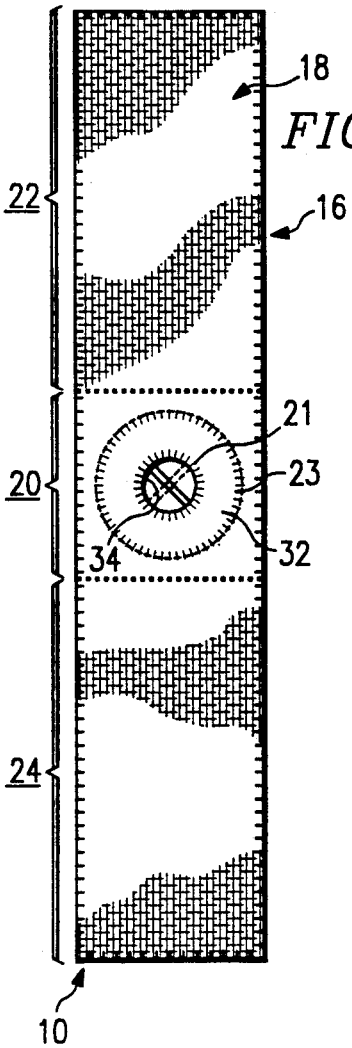
FIG. 2 is a plan view of the pacifier tether of the present invention before the pacifier is inserted.
Figure 3:
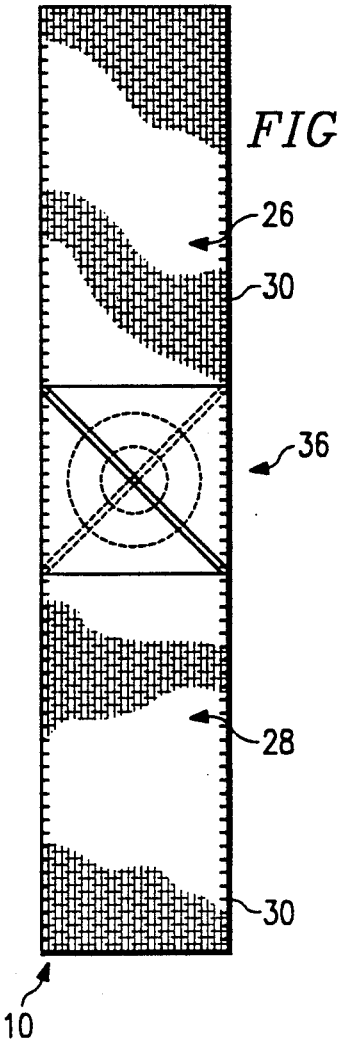
FIG. 3 is a bottom view of the pacifier tether showing the pacifier retaining pocket.

Turning now to the more specific aspects of the invention, the pacifier tether 10 is shown in plan view in FIG. 2 and in bottom view in FIG. 3. Referring now simultaneously to FIGS. 2–3, the tether 10 comprises a generally elongate body 16 having an upper fabric layer 18. Upper fabric layer has three portions: a central portion 20 and first and second extensions 22 and 24 extending from the central portion 20. The tether body 16 also includes first and second fabric layers 26 and 28 underlying the first and second extensions 22 and 24, respectively, and stitched thereto via the peripheral edge stitching 30. Lower fabric layers 26 and 28 may be omitted if desired. Moreover, while the extensions and underlying fabric layers are shown as generally rectangular in shape, such construction is exemplary and not to be taken by way of limitation. Other suitable shapes and configurations can be substituted. All that is required is that the extensions, in whatever shape or form, be capable of being involuntarily or voluntarily grasped by the child and held in the child's hand as will be described below.

According to the invention, the pacifier tether 10 further includes a reinforcing disk 32 overlying the central portion 20 of the upper fabric layer and stitched thereto via stitching 21 and 23. An aperture 34 is formed in the reinforcing disk 32 and the central portion 20 of the upper fabric layer for receiving the nipple 13 of the pacifier. The reinforcing disk 32 has two important functions. It maintains the nipple in an upright midline position and insures that the infant's nose remains spaced from the fabric. The pacifier tether 10 further includes a reinforced pocket 36 underlying the aperture 34 for retaining the pacifier base 13.

Figure 4:
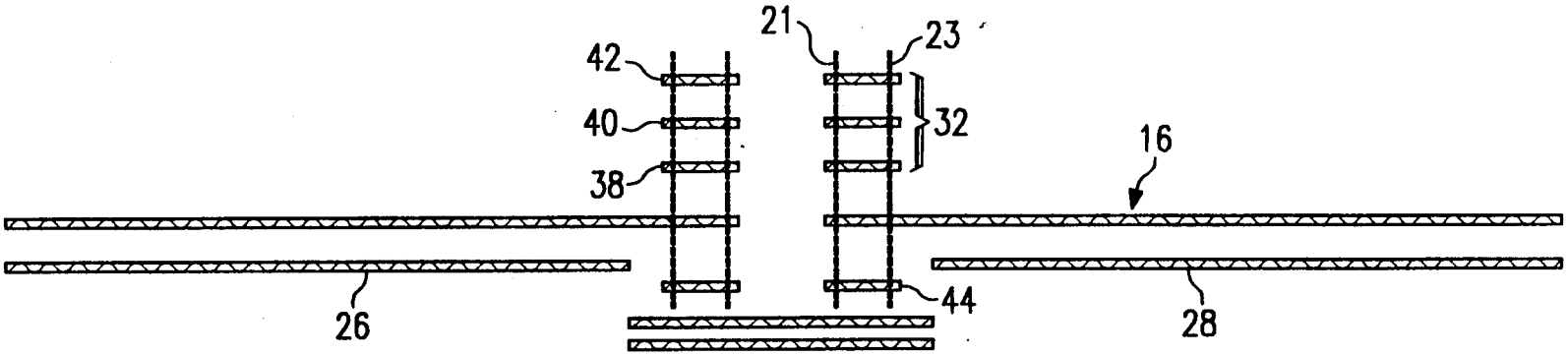
FIG. 4 is a detailed cross-sectional view of the tether showing the preferred construction of the fabric layers.
Figure 5:
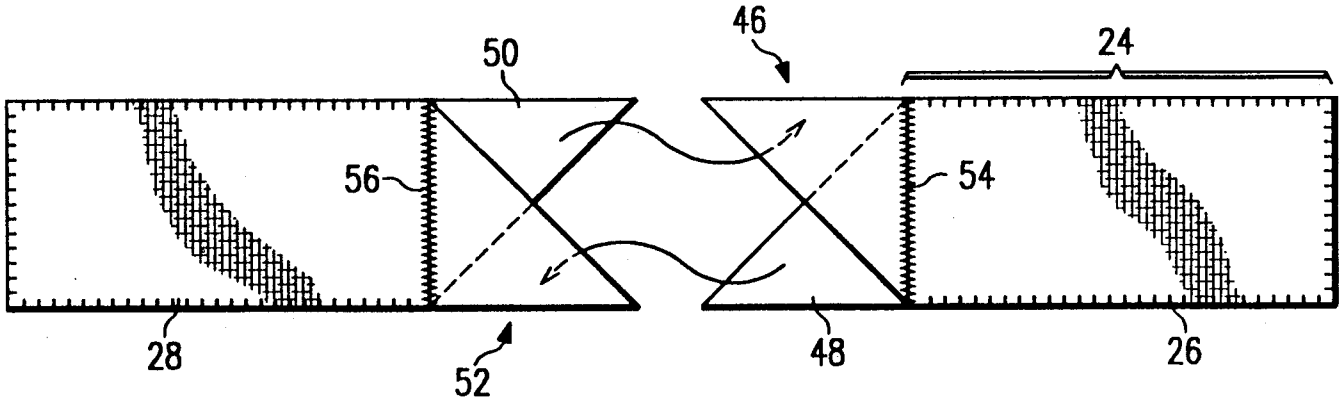
FIG. 5 is a detailed view of the construction of the bottom fabric layers of the tether prior to their assembly with the upper fabric layer.

The novel construction of the reinforcing disk 32 and the reinforced pocket 36 are best seen with reference to FIGS. 4–5. FIG. 4 is a cross-sectional view showing the various fabric layers, including the upper and lower fabric layers 18, 26 and 28 referred to above. As seen in FIG. 4, the reinforcing disk 32 preferably comprises three fabric layers, a first flannel layer 38, an interfacing layer 40 and a second flannel layer 42. Second flannel layer 42 may, alternatively, be replaced with a plastic layer to facilitate cleaning. An underlying flannel layer 44 may also be provided as shown. The reinforcing disk 32 is stitched to the upper fabric layer (and the layer 44 if used) via the stitching 21 and 23.

Referring now to FIGS. 4–5, the reinforced pocket 36 is preferably formed by four (4) square fabric pieces, each of which has been folded upon itself to form a triangle. The four pieces are identified by reference numerals 46, 48, 50 and 52. Pieces 46 and 48 are affixed to first fabric layer 26 along stitch line 54 and pieces 50 and 52 are affixed to second fabric layer 28 along stitch line 56. The pacifier base 15 is retained securely within the pocket 36 between the flannel layer 44 and the pieces 46 and 50.

The reinforcing disk 32 and the pocket 36 cooperate to retain the pacifier nipple in a secure midline orientation and safely spaced from the infant's mouth. The pacifier is readily removable from the tether to facilitate cleaning and reuse.

The tether is useful for enhancing an infant's developmental reflexes. With the infant prone or sidelying, one of the fabric extensions is placed so that one side of the infant's cheek is on top of the extension. This leaves the other fabric extension free for the infant to grasp. Alternatively, both fabric extensions are left free with the pacifier in the infant's mouth. The infant can now grasp one extension with one hand and the other fabric extension with the other hand. In still another alternative, the extensions are tied in a knot (down to the pacifier) so the infant has a firmer and larger surface area to grasp. The pacifier tether is not intended to be tied around the head or neck of the infant.

Because the sucking reflex, grasp reflex and hand-to-mouth reflex are all inborn, the infant can automatically use the device. Such use promotes nonnutritive sucking via the pacifier in addition to facilitating neurobehavioral organization, total body flexion, and tactile and visual stimulation. NNS accelerates the maturation of the sucking reflex and enhances gastrointestinal function. This results in greater weight gain with less expenditure of energy. Moreover, the tether facilitates the grasp reflex and the hand-to-mouth reflex, the latter reflex being a prerequisite for upper extremity development. The device also advantageously brings the arms midline when the infant grasps the fabric extensions of the tether. By bringing the arms midline, total body flexion is encouraged (i.e. trunk, hip, shoulder, and knee adduction and trunk and lower extremity flexion). Body flexion leads to increased tone which is one of the prerequisites for motor development. Neurobehaviorial organization is also enhanced by bringing the arms midline and by encouraging the grasp and suck reflex through use of the present invention. As such behavior comes into balance, the autonomic system improves. Further, the pacifier tether provides tactile and visual stimulation.

It should be appreciated by those skilled in the art that the specific embodiments disclosed above may be readily utilized as a basis for modifying or designing other structures for carrying out the same purposes of the present invention. For example, the reinforcing disk may be attached below the upper fabric layer, or it may be affixed within a cutout in the upper fabric layer. The pocket may include less than four retaining pieces. The fabric pieces may be affixed to each other using other fasteners or adhesives instead of stitching. In certain applications, it may only be necessary to use a single fabric extension instead of first and second extensions although two are preferred. Other types of materials are also useful to form the tether body. It should also be realized by those skilled in the art that such equivalent constructions do not depart from the spirit and scope of the invention as set forth in the appended claims.

What is claimed is:

1. A pacifier tether for use in conjunction with a pacifier to enhance developmental reflexes in an infant, the pacifier having a base and a nipple, comprising:

a generally elongate body having a central portion and first and second extensions extending therefrom;

a reinforcing disk attached to the central portion of the elongate body;

an aperture extending through the reinforcing disk and the central portion sized and configured to receive the nipple, the reinforcing disk adapted to retain the nipple in an upright midline position; and a pocket attached to the central portion and underlying the aperture sized and configured to retain the pacifier base in the tether.

2. The pacifier tether as described in claim 1 wherein the body comprises an upper fabric layer and first and second lower fabric layers stitched to the upper fabric layer.

3. The pacifier tether as described in claim 1 wherein the reinforcing disk comprises:

a first piece of fabric;

a second piece of fabric overlaying the first piece of fabric; and an interfacing located between the first and second pieces of fabric.

4. The pacifier tether as described in claim 2 wherein the pocket comprises:

a plurality of substantially square fabric pieces, each of said square fabric pieces folded under and back on itself to form a triangle-shaped piece;

wherein a first pair of said triangle-shaped pieces are stitched to the first lower fabric layer along a predetermined line; and wherein a second pair of said triangle-shaped pieces are stitched to the second lower fabric layer along a predetermined line.

5. The pacifier tether as described in claim 1 wherein the body is formed of flannel for enhanced tactile response.

6. The pacifier tether as described in claim 1 wherein the body incorporates a visual design for enhancing visual stimulation.

7. In combination, a pacifier and a tether for supporting the pacifier:

the pacifier having a base and a nipple;

the tether comprising:

a generally elongate body having a central portion and first and second extensions extending therefrom;

a reinforcing disk attached to the central portion of the elongate body;

an aperture extending through the reinforcing disk and the central portion for receiving the nipple, the reinforcing disk retaining the nipple in an upright midline position; and a pocket attached to the central portion and underlying the aperture for retaining the pacifier base in the tether wherein the tether encloses the pacifier base and leaves the nipple exposed through the aperture.

8. A pacifier tether for use in conjunction with a pacifier to enhance developmental reflexes in an infant, the pacifier having a base and a nipple, comprising:

a generally elongate body having a central portion and at least one extension extending therefrom adapted to be grasped and retained by the infant;

a reinforcing disk attached to the central portion of the elongate body;

an aperture extending through the reinforcing disk and the central portion sized and configured to receive the nipple, the reinforcing disk adapted to retain the nipple in an upright midline position; and a pocket attached to the central portion and underlying the aperture sized and configured to retain the pacifier base in the tether.

* * * * *